United States Patent [19]

Koester

[11] Patent Number: 4,650,057

[45] Date of Patent: Mar. 17, 1987

[54] ENCODER/DIVERTER UNIT FOR COIN-OPERATED MACHINE

[75] Inventor: Harold E. Koester, Las Vegas, Nev.

[73] Assignee: IGT, Reno, Nev.

[21] Appl. No.: 659,978

[22] Filed: Oct. 12, 1984

[51] Int. Cl.[4] ..... G07F 1/04; G07F 9/08

[52] U.S. Cl. ..... 194/346; 133/8 R; 193/31 A

[58] Field of Search ..... 194/1 C, 1 D, 1 K, 99, 194/100 R, 100 A, 102, 346; 193/DIG. 1, 31 A; 133/8 R

[56] References Cited

U.S. PATENT DOCUMENTS 3,916,922 11/1975 Prumm ..... 194/1 C X 4,361,161 11/1982 Johnson ..... 194/1 K X

FOREIGN PATENT DOCUMENTS 2121580 12/1983 United Kingdom ..... 194/100 A

*Primary Examiner*—F. J. Bartuska

*Attorney, Agent, or Firm*—Townsend and Townsend

[57] ABSTRACT

An encoder/diverter unit for use with a coin acceptor/rejector of a coin-actuated machine such as a gaming machine. The unit has the encoder portion coupled together with the diverter portion so that the encoder and diverter portions move with each other as a solenoid shifts the unit to divert coins from a first chute to a second chute. The encoder/diverter unit is formed of separable parts, including a basic body and an insert wall removably coupled to the basic body to pass coins of a first size and denomination. By changing the insert, the unit can be modified to pass coins of another size and denomination.

22 Claims, 9 Drawing Figures

ENCODER/DIVERTER UNIT FOR COIN-OPERATED MACHINE

This invention relates to improvements in the handling of coins in coin-actuated machines, such as those found in casinos, and more particularly, to an improved apparatus for counting coins and for diverting them to a hopper or a drop bucket.

BACKGROUND OF THE INVENTION

In conventional coin-actuated machines, such as those found in gaming casinos, coins dropped in the machine first pass through an acceptor which either accepts or rejects the coins as a function of whether they are genuine or bogus. Then, the coins pass a counter or encoder which electronically counts the coins for accounting purposes. Then, the coins move through a diverter downstream of the counter and the diverter normally channels the coins into a hopper. When a sensor in the hopper indicates that an upper level of coins has been reached in the hopper, the diverter is shifted to direct the coins into a drop bucket. This diversion of the coins into the drop bucket continues until the coin level in the hopper drops due to payout to the game players. Then the diverter returns to its initial position and directs coins once again into the hopper.

In machines of the above type, the counter is separate and upstream of the diverter, thus requiring a relatively long coin drop distance. Since this distance is relatively long, the coin drop must be almost vertical, thereby requiring a considerable amount of space to accommodate both the counter and the diverter as well as the hopper and the drop bucket. This relatively long coin drop distance frequently causes the slope of the coin path from the diverter to the hopper to be relatively flat, so that coins may need to be force-fed into the hopper rather than be allowed to fall by gravity.

Another aspect of conventional machines of the type described is that the diverter and counter must be provided for use with a coin of a particular size and denomination. This requires a considerable inventory of diverter and counter components and does not permit interchangeability of components for use with coins of different sizes and denominations.

Because of the foregoing drawbacks, a need exists for improvements in the encoding and diverting of coins in a coin-operated gaming or other machine to minimize such drawbacks without sacrificing reliability of the machine. The present invention satisfies this need.

SUMMARY OF THE INVENTION

The present invention is directed to an improved encoder/diverter unit for a coin-actuated machine in which the encoder (or counter) is integrated with the diverter so that they form a compact unit and, as the diverter is shifted, the encoder moves with the diverter. Thus, the coin drop distance past the encoder and the diverter is minimized to thereby minimize the space requirements of the unit.

Another aspect of the present invention is the interchangeability of the diverter parts to allow a basic diverter body to be used for diverting coins of different sizes and denominations. This aim is achieved by providing a removable insert coupled to the basic diverter body with each insert being reversible to accommodate coins of two different sizes and denominations and each insert having coding holes to provide for photosensing of coins of a particular size and denomination as they pass through the encoder/diverter unit. This interchangeability feature minimizes the need for a large inventory of parts and allows the basic diverter body to be used with a number of different inserts to accommodate a particular coin size and denomination. By providing each insert with coding holes at predetermined locations and by using a specific number of radiation sources and radiation sensors on the encoder portion of the unit, the same encoder portion can be used with all of the inserts. This feature minimizes production costs of the encoder/diverter unit while allowing quick assembly and disassembly of the parts of the unit with a minimum of skill.

The primary object of the present invention is to provide an improved apparatus for encoding and diverting coins after they pass through a coin acceptor of a coin-actuated machine wherein the encoder is integrated with the diverter to minimize the coin drop distance so that the path of travel from the apparatus to a hopper can be relatively steep to avoid problems associated with conventional systems where the encoder is separate from the diverter.

Another object of the present invention is to provide an improved apparatus of the type described wherein the encoder/diverter unit has interchangeable parts to accommodate it for use with coins of different sizes and denominations to thereby minimize inventory levels while at the same time providing for a quick assembly and disassembly of parts without the need for electronic adjustment to differentiate between coins of various sizes and denominations.

Other objects of this invention will become apparent as the following specification progresses, reference being had to accompanying drawings for an illustration of the invention.

IN THE DRAWINGS

Figure 1:
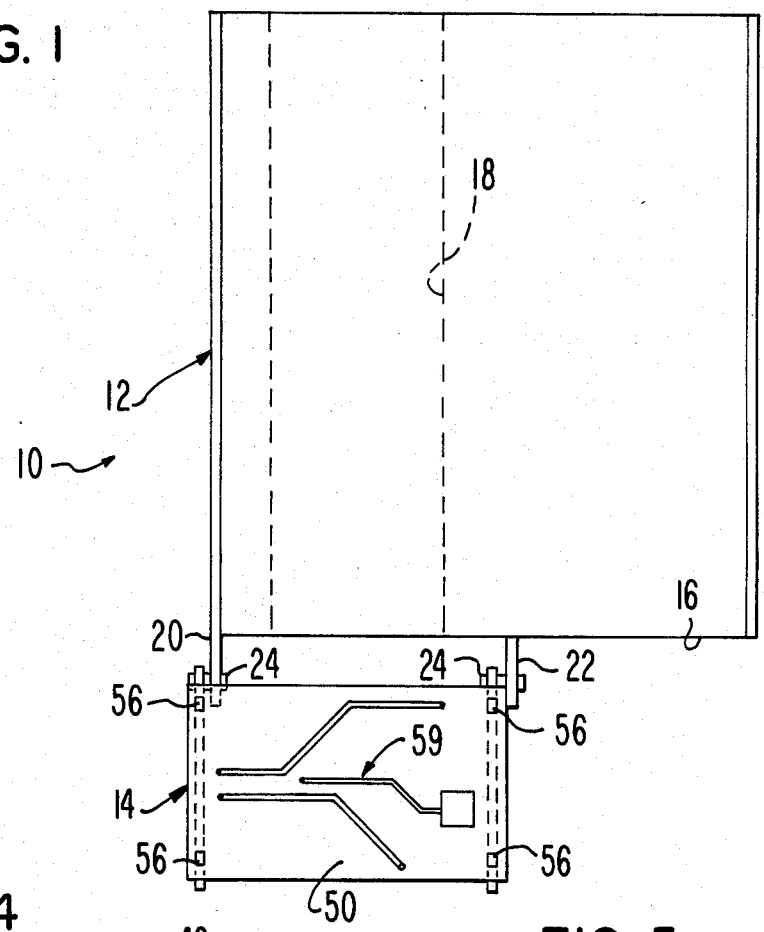
FIG. 1 is a front elevational view of a coin acceptor for a coin-actuated machine showing the encoder/diverter unit of the present invention mounted thereon.

The coin handling apparatus of the present invention is broadly denoted by the numeral 10 and includes a coin acceptor device 12 of conventional design and an improved encoder/diverter unit 14 pivotally coupled to coin acceptor device 12 near the lower margin 16 thereof. Apparatus 10 is adapted to be used with a coin actuated machine, such as a gaming machine of a casino, wherein coins are dropped vertically within 3° through a passage 18 of device 12 and past an accept/reject mechanism (not shown). If the coin is accepted, it then passes downwardly past and through a coin passage in unit 14 in which it is counted and is directed either into a hopper (not shown) or to a drop bucket (not shown).

The hopper typically has a sensor which indicates when the hopper is full of coins. When the hopper is full, unit 14 pivots relative to acceptor 12 and diverts the coins then to the drop bucket until the level of the hopper is depleted, such as by payout of the coins, whereupon the unit 14 is shifted back to its initial position in which it diverts coins into the hopper once again.

Figure 4:
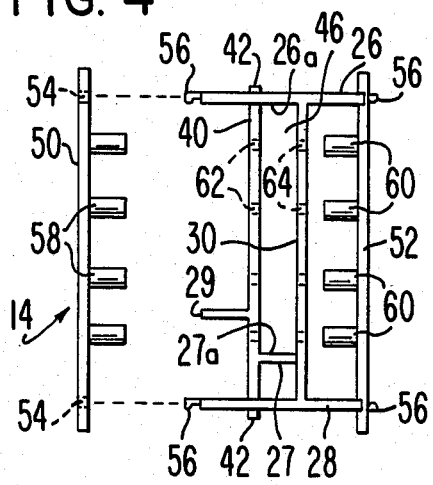
FIG. 4 is an exploded view of the encoder/diverter unit looking downwardly through the unit and showing the encoder portion separated from the diverter portion.

Unit 14 is pivotally mounted on the lower margin 16 of acceptor 12 for movement through an angle in the range of 16°. The acceptor device 12 has a pair of spaced legs 20 and 22 which depend from device 12 and are rigidly secured thereto. The legs have holes in their lower ends to removably receive the ends of a hinge pin 24, and the ends of pin 24 are held by retaining rings or clips on legs 20 and 22. Hinge pin 24 passes through a pair of side walls 26 and 28 of unit 14, side walls 26 and 28 being generally parallel with each other and spaced apart by a central wall 30 as shown in FIG. 4. Side walls 26 and 28 and central wall 30 form a basic body for unit 14 for a purpose hereinafter described.

Figure 3:
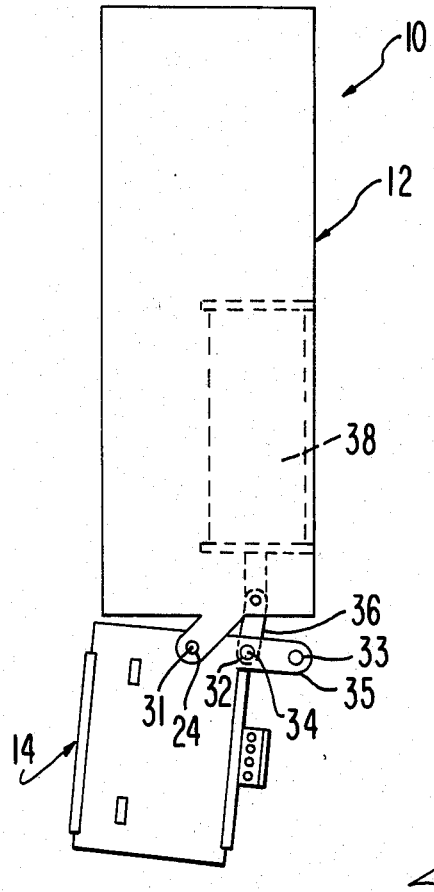
FIG. 3 is a side elevational view of the apparatus of FIGS. 1 and 2 looking in the direction of line 3—3 of FIG. 2.

Side walls 26 and 28 have each a pair of spaced holes 31 and 32 for receiving pin 24. Pin 24, for instance, is received at the ends thereof in holes 31 of side walls 26 and 28 when unit 14 is adapted to be used with coin acceptor 12 of a particular coin size and denomination, such as a 25-cent piece. The ends of hinge pin 24 are received, for instance, in the holes 32 (FIG. 3) of side walls 26 and 28 when unit 14 is to be used with a coin acceptor device 12 of a different coin size and denomination, such as a dollar coin or token. In either case, the basic body of unit 14 mentioned above is usable with different acceptor devices 12. This feature minimizes the need for a large inventory of parts for unit 14, and thereby minimizes production costs of unit 14 as well.

A rod or shaft 34 is provided on unit 14 in spanning relationship to side walls 26 and 28, rod 34 being generally parallel with rod 24. Rod 34 is adapted to be coupled to the spring-biased armature rod 36 of a solenoid 38 carried by acceptor device 12 in any suitable manner. Solenoid 38 has its longitudinal axis generally vertical and its lower end coupled intermediate the ends of rod 34. Rod 34 is removably coupled at its ends in holes 32 in side walls 26 and 28 by removable retaining rings or clips. In the alternative, for an acceptor device 12 usable with a different coin size and denomination, rod 34 is coupled to holes 33 in the outer ends of a pair of laterally projecting arms 35 integral with respective side walls 26 and 28.

Figure 5:
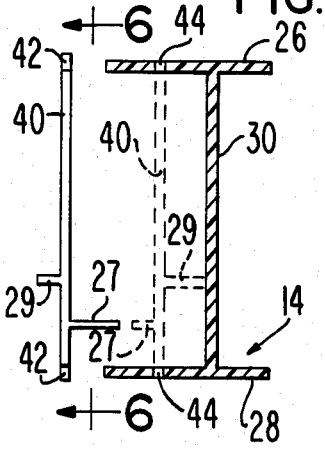
FIG. 5 is a view similar to FIG. 4 but showing an insert of the unit separated from the basic body of the unit.
Figure 6:
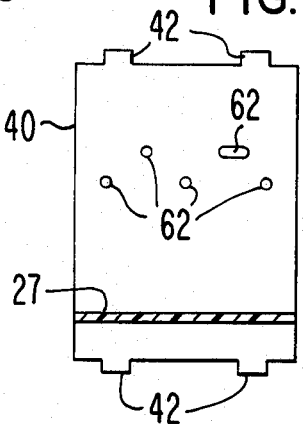
FIG. 6 is a side elevational view of the insert of FIG. 5 when it has been removed from the basic body of the unit.

Device 14 is shown in more detail in FIGS. 4–7 and includes, as a basic body, side walls 26 and 28 and central wall 30. To accommodate device 14 for a particular coin size and denomination, an insert 40 is removably coupled to side walls 26 and 28. This insert 40 is a flat rigid wall with end tabs 42 at the opposed margins thereof as shown in FIG. 6. These end tabs are removably received in slots 44 (FIG. 5) of side walls 26 and 28, the various parts of unit 14 being of plastic so that they are slightly flexible to allow insert 40 to be put easily into place with tabs 42 thereof removably received within slots 44.

With insert 40 in place as shown in FIG. 4, central wall 30 and insert 40 define the sides of a coin-receiving passage 46 (FIG. 4) which is generally aligned with the coin receiving passage 18 of device 12 as shown in FIG. 1. The ends of passage 46 are determined by side wall 26 and a wall segment 27 rigid to and projecting laterally from one face of insert 40. FIG. 5 shows that wall segment 27 is rigid to insert 40. For instance, passage 46 shown in FIG. 4 is suitable to accommodate a fifty-cent piece. To accommodate passage 46 for a different size coin, such as for a five-cent piece, insert 40 can be inverted such that a second wall segment 29 is put into position in place of segment 27, wall segment 29 being on the opposite face of insert 40 as shown in FIGS. 4 and 5. When the insert is in place with wall segment 29 extending to central wall 30, a passage **46*a* of a different size is formed as shown in dashed lines in FIG. 5. In this way, a single insert 40** can be used to form two coin passages of different widths.

The encoder portion of unit 14 includes a pair of printed circuit boards 50 and 52 which are mounted at opposed, respective end margins of side walls 26 and 28. Printed circuit board 50 has pairs of holes 54 at ends thereof for removably receiving spaced, projecting tabs 56 on the adjacent end margins of side walls 26 and 28. FIG. 4 shows circuit board 50 separated from unit 14; whereas, circuit board 52 is coupled to the unit.

Circuit board 50 has a number of spaced light emitting diodes or other radiation sources 58 (FIG. 4) coupled thereto and projecting laterally therefrom. Diodes 58 are coupled to circuitry 59 on board 50 and are adapted to direct radiation beams laterally through holes in insert 40 and central wall 30 and to sensors 60 (FIG. 4) responsive to the radiation beams. The signals generated by sensors 60 are directed to circuitry 59 which is operable to provide signals representing the number of coins passing through passage 46 (FIG. 4).

Typically, there will be five diodes 58 and the same number of sensors 60 directly aligned with respective diodes, generally, only three of the five diodes and sensors are needed at any one time to provide an effective count of the coins passing through unit 14. The holes in insert 40 are denoted by the numerals 62 (FIG. 6). The holes in central wall 30 are denoted by the numeral 64 (FIG. 4). There are five holes 64 in central wall 30; whereas, insert 40 has only three holes 62. These holes 62 are aligned with certain of the holes 64 of central wall 30 so that, for a particular denomination of coin, light will only enter said certain holes 64 and strike the corresponding sensors 60 aligned therewith. When insert 40 is reversed as shown in dashed lines in FIG. 5, a different set of holes 62 will become aligned with corresponding holes 64 and the encoder or counter portion of unit 14 will be operable for counting coins of a different size and denomination.

Figure 7:
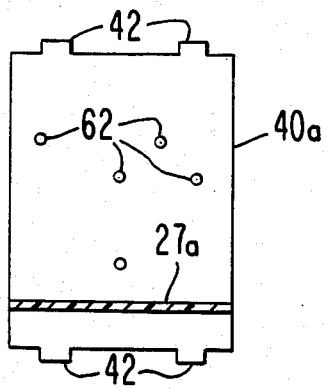
FIG. 7 is a view similar to FIG. 6 but showing another insert for a coin of a different size and denomination.
Figure 2:
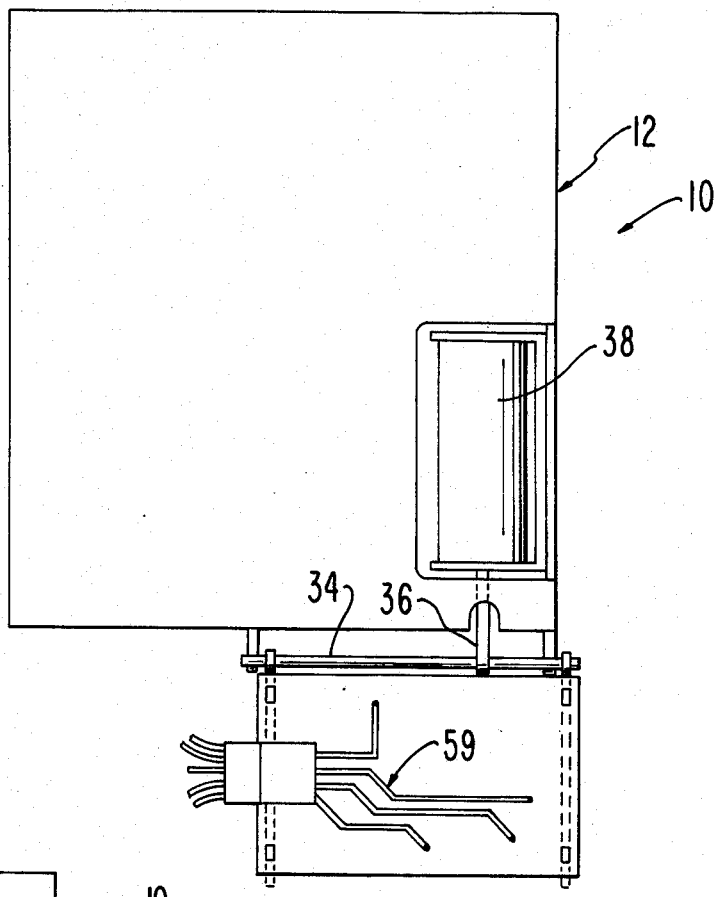
FIG. 2 is a view similar to FIG. 1 but showing a rear elevational view of the acceptor and encoder/diverter unit.

FIG. 6 shows holes 62 in a unit in insert 40 for use in counting coins of a first size and denomination; whereas, FIG. 7 shows holes 62 in an insert **40*a* which is adapted to count coins of a second size and denomination. To this end, insert 40*a* (FIG. 7) has a wall segment 27*a* which is at a different location from wall segment 27 of FIG. 6. However, insert 40*a* still has tabs 42 at the same locations as tabs 42 of inserts 40 (FIG. 6) so that insert 40***a* of FIG. 7 can readily replace insert 40 of FIG. 6 in coupled relationship to side walls 26 and 28 as shown in FIG. 4.

Figure 8:
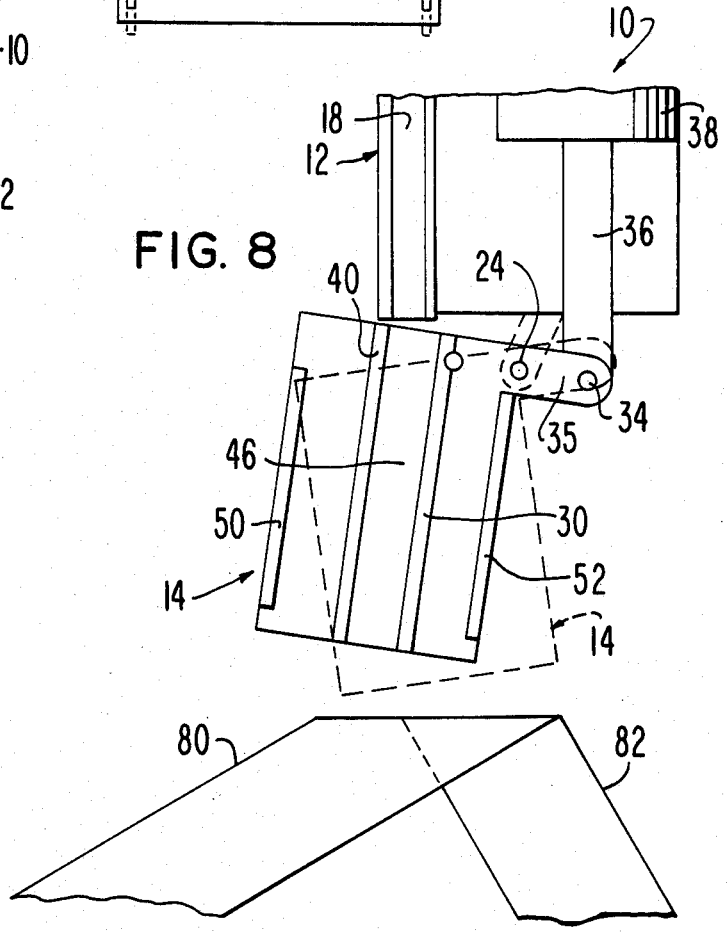
FIG. 8 is a fragmentary, schematic view through the encoder/diverter unit showing the way in which it is coupled to a coin acceptor adapted for use with a coin of a particular size and denomination.
Figure 9:
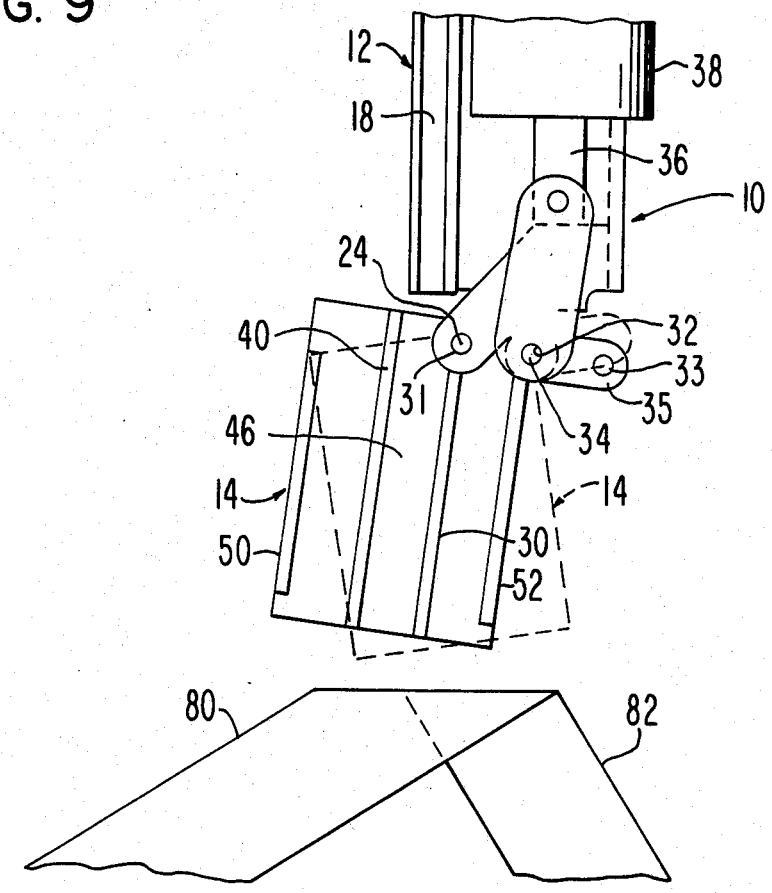
FIG. 9 is a view similar to FIG. 8 but showing the encoder/diverter unit in use with a different coin.

In the operation of apparatus 10, reference is had to FIGS. 8 and 9 wherein acceptor device 12 and unit 14 are shown somewhat schematically above chutes 80 and 82 which lead to a drop bucket and a hopper, respectively. Chutes 80 and 82 both have upper open ends for receiving coins after they have passed through diverter unit 14. For purposes of illustration, device 12 has passage 18 therethrough in both FIGS. 8 and 9. Rod 34 in FIG. 8 is shown as being coupled to the outer holes 33 of arms 35 and rod 34 in FIG. 9 is shown as passing through holes 34 which are the same holes as receiving rod 24 in FIG. 8. Initial tilt or equilibrium position of encoder/diverter unit 14 is determined by the spring bias of the solenoid 38. Typically, rod 36 of solenoid 38 normally is biased outwardly from the solenoid as shown in FIGS. 8 and 9. When the solenoid is energized, unit 14 pivots from the full line position of FIGS. 8 and 9 to the dashed line position thereof. In this case, the solenoid is normally deactuated. In the alternative, the solenoid could be normally actuated. Thus, when a coin passing through passage 18 of acceptor device 12 of either FIG. 8 or FIG. 9 is to be delivered to the hopper, the solenoid 38 is actuated, causing unit 14 to pivot in a counterclockwise sense when viewing FIG. 8 or FIG. 9, whereby the coin is directed into chute 82 and then into the hopper. The hopper has a sensor (not shown) which indicates the level of coins in the hopper. When this level is reached, the sensor signal will cause the solenoid to be deactuated. All coins will then be directed into chute 80 and then into the overflow bucket (not shown) until the level sensor of the hopper once again indicates that coins can be received in the hopper. Then, the solenoid will again be actuated causing the unit 14 to pivot once again in a counterclockwise sense when viewing FIG. 8 or FIG. 9. Then, all coins will be directed into the hopper until the hopper fills up, and so on.

As discussed above, the encoder or counter portion of the unit 14 operates to monitor the coins accepted by acceptor device 12. The encoder portion also detects stringers, i.e., coins on strings, riding a coin back up the encoder portion.

The purpose of the diverter portion of unit 14 is to divert coins from one chute to another as necessary. The diverter can be used for diverting coins to more than the two positions shown in FIGS. 8 and 9. If required, the diverter can be used to divert up to six positions allowing for various coin sizes to be moved to any position at random.

Except for the circuit boards 50 and 52 of unit 14, the unit itself can be molded of various parts to form a unitary construction with removable and reversible inserts to allow for one assembly to operate for any and all coin denominations, foreign and domestic, up to a certain coin thickness, such as about 45 mm. Using a single basic body for unit 14 reduces warehouse inventory levels. Also, injection molded parts can be molded out of Zytel 101 which will reduce part costs as well as reduce weight (mass) and increase the working life of the part. However, other plastics can be used, such as nylons and polycarbonates.

Since the encoder portion of unit 14 moves with and is coupled to the diverter portion, the coin drop distance through the unit 14 is minimized. The optics of the encoder portion of unit 14 does not require electronic adjustment to differentiate between the various coins. The adjustment is made automatically when an insert 40 is put in place as shown in FIG. 4 to form coin passage 46.

The printed circuit boards 50 and 52 require no hardware for mounting. The mounting of these boards is achieved by tabs 56 as described above with respect to FIGS. 4 and 5. Unit 14 can be powered with solenoid 38 in the normally on position or the normally off position, whereby the unit 14 is highly versatile. Unit 14 is typically powered by a 24 volt AC solenoid, continous duty. If unit 14 is to be used in more than two positions, actuators, such as cams, can be used to position unit 14. Suitable control means (not shown) is provided to operate the electronic circuitry associated with the encoder (counter) portion and solenoid 38.

I claim:

1. In coin handling apparatus having a coin acceptor/rejector device, a first chute for directing coins to a hopper, and a second chute for directing coins to a drop bucket, the cutes being spaced below said acceptor device:

an encoder/diverter unit having a coin passage therethrough and means thereon for mounting the same in the space between the acceptor device and the chutes for pivotal movement relative to the acceptor device from a first positon with the passage aligned with said first chute to a second position with the passage aligned with said second chute, said unit including an encoder portion and a diverter portion, said portions being coupled together for movement between said first and second positions, said encoder portion having means for counting the number of coins passing through said passages, said diverter portion having means to direct coins into the chute aligned with said passage.

2. Apparatus as set forth in claim 1, wherein said mounting means includes pivot structure.

3. Apparatus as set forth in claim 1, wherein the diverter portion includes a pair of walls defining the sides of said passage, one of the walls being removable to permit a change in a dimension of said passage.

4. Apparatus as set forth in claim 1, wherein said diverter portion includes a central wall, a pair of spaced side walls rigidly secured to the end margins of the central wall, and an insert wall removably coupled to the side walls in spaced relationship to the central wall to form said passage with said central wall.

5. Apparatus as set forth in claim 4, wherein said insert wall has a tab on each end margin, respectively, said side walls having slots for receiving adjacent, respective tabs of the insert wall.

6. Apparatus as set forth in claim 4, wherein said encoder portion includes a pair of printed circuit boards having means for removably mounting the same on respective end margins of said side walls.

7. Apparatus as set forth in claim 6, wherein the end margin of each side wall includes a tab, each printed circuit board having a hole for receiving a respective tab, whereby the printed circuit boards are removably mounted on the side walls.

8. Apparatus as set forth in claim 4, wherein the side walls have a pair of aligned holes therethrough, said mounting means including a shaft having ends removably pivotally received within each hole, the shaft adapted to be coupled to the acceptor device, whereby the unit is pivotally mounted on the device.

9. Apparatus as set forth in claim 1, wherein is included a solenoid carried by the device, and means coupling the solenoid with said unit to pivot the same relative to said device.

10. Coin handling apparatus comprising:

a coin acceptor/rejector device;

a first chute spaced below said acceptor device for directing coins to a hopper;

a second chute spaced below said acceptor device for directing coins to a drop bucket;

an encoder/diverter unit in the space between the device and said chutes, said unit having a coin passage therethrough and having means thereon for mounting the same for pivotal movement relative to the acceptor device from a first position with the passage aligned with said first chute to a second position with said passage aligned with said second chute, said unit including an encoder portion and a diverter portion, said portions being coupled together for movement with each other between said first and said second positions, said encoder portion having means for counting the number of coins passing through said passage, said diverter portion having means to direct coins into the chute aligned with said passage; and means coupled with said unit for moving the same between said positions.

11. Apparatus as set forth in claim 10, wherein said mounting means includes pivot structure.

12. Apparatus as set forth in claim 10, wherein the diverter portion includes a pair of walls defining the sides of said passage, one of the walls being removable from the unit to permit a change in a dimension of said passage.

13. Apparatus as set forth in claim 12, wherein said diverter portion includes a central wall, a pair of spaced side walls rigidly secured to the end margins of the central wall, and an insert wall removably coupled to the side walls in spaced relationship to the central wall to form said passage with said central wall.

14. Apparatus as set forth in claim 13, wherein said insert wall has a tab on each end margin, respectively, said side walls having slots for receiving adjacent, respective tabs of the insert wall.

15. Apparatus as set forth in claim 13, wherein said encoder portion includes a pair of printed circuit boards having means for removably mounting the same on respective end margins of said side walls.

16. Apparatus as set forth in claim 15, wherein the end margin of each side wall includes a tab, each printed circuit board having a hole for receiving a respective tab, whereby the printed circuit boards are removably mounted on the side walls.

17. Apparatus as set forth in claim 13, wherein the side walls have a pair of aligned holes therethrough, said mounting means including a shaft having ends removably pivotally received within each hole, the shaft adapted to be coupled to the acceptor device, whereby the unit is pivotally mounted on the device.

18. Apparatus as set forth in claim 10, wherein said moving means includes a solenoid carried by the device, and means coupling the solenoid with said unit to pivot the same relative to said device.

19. In coin handling apparatus having a coin acceptor/rejector device, a first chute for directing coins to a hopper, and a second chute for directing coins to a drop bucket:

an encoder/diverter unit having a coin passage therethrough and means thereon for mounting the same for movement relative to the acceptor device from a first position with the passage aligned with said first chute to a second position with the passage aligned with said second chute, said unit including an encoder portion and a diverter portion, said portions being coupled together for movement between said first and said second positions, said encoder portion adapted for counting the number of coins passing through said passage, said diverter portion being adapted to direct coins into the chute aligned with said passage, said diverter portion including a central wall, a pair of spaced side walls rigidly secured to the end margins of the central wall, and an insert wall removably coupled to the side walls in spaced relationship to the central wall to form said passage with said central wall, the insert wall having a pair of opposed faces and at least one wall segment secured to and extending laterally from one face thereof, said segment adapted to extend toward the central wall to form one end boundary of said passage, said insert wall being reversible so that the opposite face thereof is in facing relationship to the central wall to form a passage of a second width.

20. In coin handling apparatus having a coin acceptor/rejector device, a first chute for directing coins to a hopper, and a second chute for directing coins to a drop bucket:

an encoder/diverter unit having a coin passage therethrough and means thereon for mounting the same for movement relative to the acceptor device from a first position with the passage aligned with said first chute to a second position with the passage aligned with said second chute, said unit including an encoder portion and a diverter portion, said portions being coupled together for movement between said first and said second positions, said encoder portion adapted for counting the number of coins passing through said passage, said diverter portion being adapted to direct coins into the chute aligned with said passage, said diverter portion including a central wall, a pair of spaced side wall rigidly secured to the end margins of the central wall, and an insert wall removably coupled to the side walls in spaced relationship to the central wall to form said passage with said central wall, said encoder portion including a pair of printed circuit boards having means for removably mounting the same on respective end margins of said side walls, one of the printed circuit boards having a plurality of spaced radiation emitters thereon, the other printed circuit board having a plurality of radiation sensors thereon aligned with respective radiation emitters, said central and insert walls having respective holes for allowing radiation from certain emitters to strike the corresponding sensors, the number of holes in the insert wall being less than the number of light emitters and light sensors.

21. Coin handling apparatus comprising:

a coin acceptor/rejector device;

a first chute for directing coins to a hopper;

a second chute for directing coins to a drop bucket;

an encoder/diverter unit between the device and said chutes, said unit having a coin passage therethrough and having means thereon for mounting the same for movement relative to the acceptr device from a first position with the passage aligned with said first chute to a second position with said passage aligned with said second chute, said unit including an encoder portion and a diverter portion, said portions being coupled together for movement with each other between said first and said second positions, said encoder portion adapted for counting the number of coins passing through said passage, said diverter portion being adapted to direct coins into the chute aligned with said passage; and means coupled with said unit for moving the same between said positions, the diverter portion including a pair of walls defining the sides of said passage, one of the walls being removable from the unit to permit a change in a dimension of said passage, said diverter portion including a central wall, a pair of spaced side wall rigidly secured to the end margins of the central wall, and an insert wall removably coupled to the side walls in spaced relationship to the central wall to form said passage with said central wall, the insert wall having a pair of opposed faces and at least one wall segment secured to and extending laterally from one face thereof, said segment adapted to extend toward the central wall to form one end boundary of said passage, said insert wall being reversible so that the opposite face thereof is in facing relationship to the central to form a passage of a second width.

22. Coin handling apparatus comprising:

a coin acceptor/rejector device;

a first chute for directing coins to a hopper;

a second chute for directing coins to a drop bucket;

an encoder/diverter unit between the device and said chutes, said unit having a coin passage therethrough and having means thereon for mounting the same for movement relative to the acceptor device from a first position with the passage aligned with said first chute to a second position with said passage aligned with said second chute, said unit including an encoder portion and a diverter portion, said portions being coupled together for movement with each other between said first and said second postions, said encoder portion adapted for counting the number of coins passing through said passage, said diverter portion being adapted to direct coins into the chute aligned with said passage; and means coupled with said unit for moving the same between said positions, the diverter portion including a pair of walls defining the sides of said passage, one of the walls being removable from the unit to permit a change in a dimension of said passage, said diverter portion further including a central wall, a pair of spaced side walls rigidly secured to the end margins of the central wall, and an insert wall removably coupled to the side walls in spaced relationship to the central wall to form said passage with said central wall, said encoder portion including a pair of printed circuit board having means for removably mounting the same on respective end margins of said side walls, one of the printed circuit boards having a plurality of spaced radiation emitters thereon, the other printed circuit board having a plurality of radiation sensors thereon alinged with respective radiation emitters, said central and insert walls having respective holes for allowing radiation from certain emitters to strike the corresponding sensors, the number of holes in the insert wall being less than the number of light emitters and light sensors.

* * * * *